US007063060B2

(12) United States Patent
Daly

(10) Patent No.: US 7,063,060 B2
(45) Date of Patent: Jun. 20, 2006

(54) AIR INDUCTION SYSTEM HAVING AN INTAKE MANIFOLD INCLUDING A THROTTLE BODY

(75) Inventor: Paul Desmond Daly, Troy, MI (US)

(73) Assignee: Siemens VDO Automotive Inc., Chatham (CA)

( * ) Notice: Subject to any disclaimer, the term of this patent is extended or adjusted under 35 U.S.C. 154(b) by 0 days.

(21) Appl. No.: 10/951,408

(22) Filed: Sep. 28, 2004

(65) Prior Publication Data

US 2005/0092296 A1 May 5, 2005

Related U.S. Application Data

(60) Provisional application No. 60/516,550, filed on Oct. 31, 2003.

(51) Int. Cl.
*F02M 35/10* (2006.01)

(52) U.S. Cl. ..... 123/184.21; 123/198 E

(58) Field of Classification Search ..... 123/362, 123/399, 472, 184.21, 198 E, 184.53, 184.57, 123/184.61
See application file for complete search history.

(56) References Cited

U.S. PATENT DOCUMENTS 4,790,864 A 12/1988 Kostun
5,125,940 A * 6/1992 Stanhope et al. ..... 123/198 E
5,158,045 A 10/1992 Arthur et al.
5,163,387 A 11/1992 Lee ..... 123/52 M
5,394,850 A 3/1995 Murphy et al.
5,424,494 A 6/1995 Houle et al. ..... 181/229
5,477,819 A 12/1995 Kopec
5,713,322 A * 2/1998 Mausner et al. ..... 123/184.21
5,818,117 A * 10/1998 Voss et al. ..... 123/399
5,865,863 A 2/1999 DeSousa et al.
5,918,572 A * 7/1999 Suzuki ..... 123/184.57
6,098,586 A 8/2000 Bloomer ..... 123/184.21
6,463,901 B1 * 10/2002 Cuddihee et al. ..... 123/184.21
6,564,766 B1 * 5/2003 Ayton ..... 123/184.21

FOREIGN PATENT DOCUMENTS

JP 10-339222 A * 12/1998 ..... 123/184.21

* cited by examiner

*Primary Examiner*—Willis R. Wolfe, Jr.
(74) *Attorney, Agent, or Firm*—Pasquale Musacchio

(57) ABSTRACT

An air induction system for an internal combustion engine. The system includes an air cleaner having an air intake and an intake manifold for distributing air to cylinders of the engine. A throttle body installed in a neck portion of the manifold is also provided, wherein the throttle body serves to regulate a flow of air to the manifold. In addition, the system includes a hose for providing air from the air cleaner to the manifold and the throttle body, wherein the hose includes a first end which is affixed to both the throttle body and the manifold. The first end also includes sealing elements for sealing the throttle body and the manifold.

20 Claims, 3 Drawing Sheets

AIR INDUCTION SYSTEM HAVING AN INTAKE MANIFOLD INCLUDING A THROTTLE BODY

CROSS REFERENCE TO RELATED APPLICATION AND PRIORITY CLAIM

This application claims the benefit of U.S. Provisional Application No. 60/516,550 filed on Oct. 31, 2003 in the name of Paul Desmond Daly and entitled INTEGRATED THROTTLE BODY, MANIFOLD, RESONATOR OR HOSE, which is incorporated by reference herein in its entirety.

FIELD OF THE INVENTION

This invention relates to air induction systems, and more particularly, to an integrated manifold having an integrated throttle body for reducing assembly time and parts associated with manufacturing and assembling an air induction system.

BACKGROUND OF THE INVENTION

An air induction system is used in conjunction with an internal combustion engine in order to manage air flow and provide efficient engine combustion. Referring to FIG. 1, a block diagram for a conventional air induction system 10 is shown. The system 10 includes an air cleaner 11 having an air intake for receiving outside air and an air outlet from which clean air exits. A hose 12 is then used to route the clean air to a throttle body 14 which is attached to a manifold neck portion 18 of an intake manifold 16. The throttle body 14 serves to regulate the flow of air to the intake manifold 16. The intake manifold 16 includes runners 20 which serve to distribute the air to cylinders of the engine in a manner suitable for achieving the proper combustion of fuel. In some induction systems, a resonator may be connected between the air cleaner 12 and the throttle body 14 in order to reduce undesirable engine noise.

A typical process for assembling the system 10 includes using bolts to mount the throttle body 14 onto the manifold neck 18. The assembly process also includes using a hose clamp to affix the hose to an inlet of the throttle body 14. As a result, assembly of the conventional system 10 requires attachment of the throttle body 14 at two different locations. In addition, seals are needed at both attachment locations in order to provide a substantially airtight path suitable for induction flow.

In order to reduce costs, it is desirable to minimize the extent of assembly operations and the number of parts that are required to assemble an induction system. Further, due to styling considerations, aerodynamics and the addition of vehicle systems components, the space available in modern engine compartments is limited. Therefore, it is desirable to reduce the size of induction systems.

SUMMARY OF THE INVENTION

An air induction system for an internal combustion engine is disclosed. The system includes an air cleaner having an air intake and an intake manifold for distributing air to cylinders of the engine. A throttle body located in a neck portion of the manifold is also provided, wherein the throttle body serves to regulate a flow of air to the manifold. In addition, the system includes a hose for providing air from the air cleaner to the manifold and the throttle body, wherein the hose includes a first end which is affixed to both the throttle body and the manifold.

DETAILED DESCRIPTION OF THE INVENTION

Figure 1:
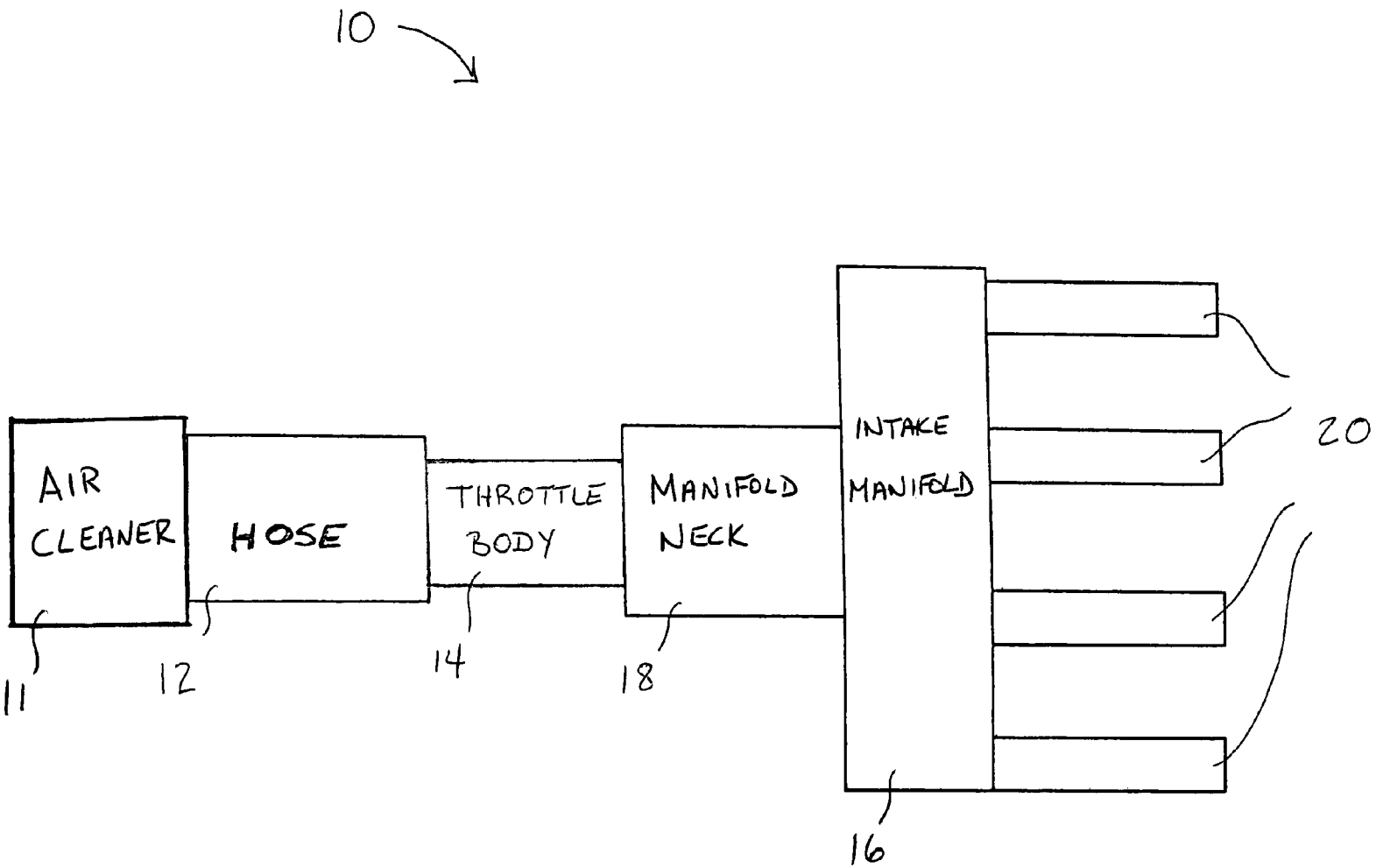
FIG. 1 is depicts a conventional air induction system for an internal combustion engine.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of FIGS. 1–3.

Figure 2:
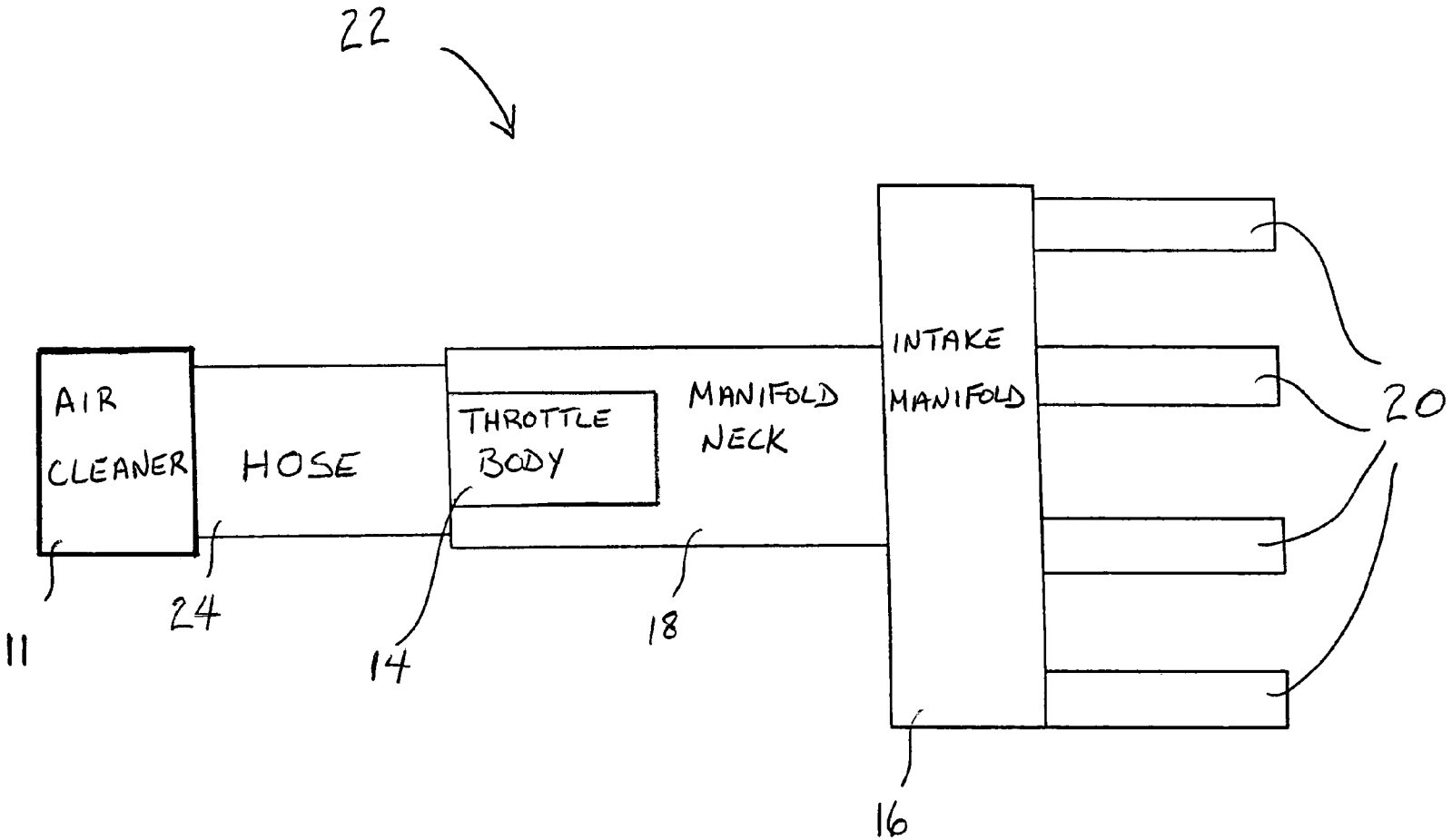
FIG. 2 is depicts an air induction system having an intake manifold which includes an integrated throttle body.
Figure 3:
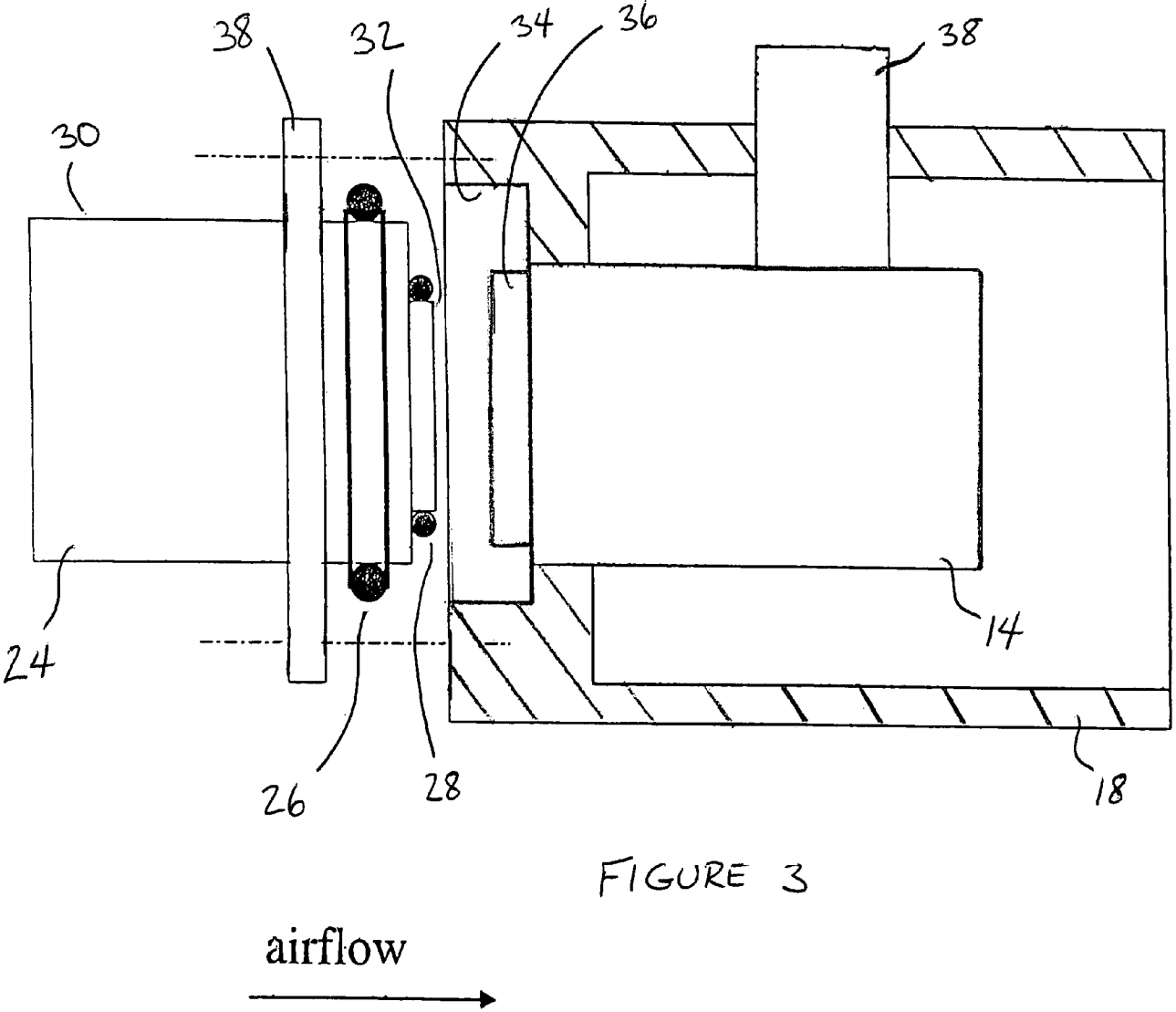
FIG. 3 depicts first and second sealing elements and surfaces and a cross sectional view of a manifold neck of the intake manifold.

Referring to FIGS. 2 and 3, an air induction system 22 in accordance with the present invention is shown. In the system 22, the throttle body 14 is inserted inside the manifold neck 18 of the intake manifold 16. The system 22 further includes a sealing hose 24 which extends from an air cleaner. The hose 24 includes first 26 and second 28 sealing elements. By way of example, the first 26 and second 28 sealing elements may each be o-rings. The first sealing element 26 is positioned around an outer surface 30 of the hose 24 and the second sealing element 28 is positioned around a boss element 32 formed on the hose 24. In an alternate embodiment the first 26 and second 28 sealing elements are integrated with the hose 24 to form a one piece configuration.

The first sealing element 26 is adapted to mate with a first sealing surface 34 formed in the manifold neck 18 to thus form a first seal interface. The second sealing element 28 is adapted to mate with a second sealing surface 36 formed in the throttle body 14 to form a second seal interface. The first seal interface serves to inhibit outside air from being drawn around the throttle body 14 and into the intake manifold 16. The second seal interface serves to inhibit leakage of induction airflow. The hose 24 is affixed to the manifold neck 18 by an attachment flange 38 and bolts. As a result, the seal between the throttle body 14 and the manifold neck 18 described in relation to FIG. 1 is eliminated. In an alternate embodiment, a resonator device including the first 26 and second 28 sealing elements may be connected to intake manifold 16 instead of the hose 24. In addition, the throttle body and the manifold may be fabricated from a one material thus eliminating the need for first seal interface.

As such, the present invention eliminates the need for bolts in order to affix the throttle body 14 to the manifold neck 18 as described in relation to FIG. 1. Further, the hose clamp used to affix the hose 12 to the throttle body 14 as described in relation to FIG. 1 is now replaced by standard bolts, which are less expensive. The bolts may also be replaced by twist lock arrangements, such as that described in U.S. Pat. No. 6,299,661 entitled TWIST FIT CONNECTION FOR AIR CLEANERS to Stephen F. Bloomer and assigned to Siemens Canada Limited. In addition, the system 22 may be assembled with greater expediency through the elimination of the assembly step in which the throttle body 14 is affixed to the manifold neck 18 of intake manifold 16. In addition, the overall size of the system 22 is reduced due to location the throttle body 14 within the manifold neck 18.

A conventional manifold includes sensors such as a temperature sensor or a manifold absolute pressure (MAP) sensor, both of which extend through an intake manifold. Such sensors are sealed in a well known manner so as to inhibit air leakage. The throttle body 14 of the present invention includes an electrical connector. Due to positioning of the throttle body 14 within the manifold neck 18, the electrical connector also extends through the intake manifold. In order to reduce the number of seals that are used, the connector is integrated with a sensor such as a temperature sensor or a MAP sensor to form a combined connector and sensor device 38 which extends through the manifold neck 18 of the intake manifold 16. The device 38 may then be sealed in the same manner as conventional sensors.

This invention is applicable to all gasoline engines having a throttle body device and to engines having a dual throttle body design. Further, some Diesel engines also now have a similar throttle body device. As such, the present invention is also applicable to such Diesel engines.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. An air induction system for an internal combustion engine, comprising:

an air cleaner having an air intake;

an intake manifold for distributing air to cylinders of said engine;

a throttle body located in said manifold, wherein said throttle body regulates a flow of air to said manifold; and a hose for providing air from said air cleaner to said manifold and said throttle body, said hose having a first end affixed to both said throttle body and said manifold.

2. The system according to claim 1, wherein said first end includes sealing elements for scaling said throttle body and said manifold.

3. The system according to claim 1 further including a device which includes a sensor and an electrical connector for said throttle body.

4. The system according to claim 1 further including an attachment flange for removably securing said first end to said throttle body and said manifold.

5. The system according to claim 1, wherein said throttle body is located within a manifold neck.

6. The system according to claim 5, wherein said sealing elements include o-rings.

7. A method for assembling an air induction system for an internal combustion engine, comprising the steps of:

providing an air cleaner having an air intake;

providing an intake manifold for distributing air to cylinders of said engine; installing a throttle body in said manifold, wherein said throttle body regulates a flow of air to said manifold; and providing a hose for supplying air from said air cleaner to said manifold and said throttle body; and affixing a first end of said hose to both said throttle body and said manifold.

8. The method according to claim 7, wherein said throttle body is installed within a manifold neck.

9. The method according to claim 7 further including the step of installing a device which includes a sensor and an electrical connector for said throttle body in said manifold.

10. The method according to claim 7 further including the step of attaching a flange for removably securing said first end to said throttle body and said manifold.

11. The method according to claim 7 further including the step of sealing said throttle body and said manifold.

12. The method according to claim 11, wherein o-rings are used in said step of sealing throttle body and said manifold.

13. An air induction system for an internal combustion engine. comprising:

an air cleaner having an air intake;

an intake manifold for distributing air to cylinders of said engine, said manifold having a manifold neck;

a throttle body located in said manifold neck, wherein said throttle body regulates a flow of air to said manifold;

a hose for providing air from said air cleaner to said manifold and said throttle body, said hose having a first end affixed to both said throttle body and said manifold neck; and sealing elements located on said first end for sealing said throttle body and said manifold neck.

14. The system according to claim 13 further including an attachment flange for removably securing said first end to said throttle body and said manifold.

15. The system according to claim 13 further including a device which includes a sensor and an electrical connector for said throttle body.

16. The system according to claim 15, wherein said sensor is a temperature sensor.

17. The system according to claim 15, wherein said sensor is a pressure sensor.

18. The system according to claim 13, wherein said scaling elements include o-rings.

19. The system according to claim 18, wherein a first o-ring is located on an outside surface of said first end and a second 0-ring is located on a boss element formed on said first end.

20. The system according to claim 19, wherein said manifold neck and said throttle body each include mating surfaces for receiving said first and second o-rings for forming first and second seal interfaces, respectively.

* * * * *